US011196211B2

(12) United States Patent
Ko

(10) Patent No.: US 11,196,211 B2
(45) Date of Patent: Dec. 7, 2021

(54) EXPANDABLE CONNECTOR ASSEMBLY

(71) Applicant: LG Chem, Ltd., Seoul (KR)

(72) Inventor: Dong-Wan Ko, Daejeon (KR)

(73) Assignee: LG Chem, Ltd.

( * ) Notice: Subject to any disclaimer, the term of this patent is extended or adjusted under 35 U.S.C. 154(b) by 0 days.

(21) Appl. No.: 16/761,520

(22) PCT Filed: Mar. 20, 2019

(86) PCT No.: PCT/KR2019/003264
§ 371 (c)(1),
(2) Date: May 5, 2020

(87) PCT Pub. No.: WO2020/004775
PCT Pub. Date: Jan. 2, 2020

(65) Prior Publication Data

US 2020/0266573 A1 Aug. 20, 2020

(30) Foreign Application Priority Data

Jun. 29, 2018 (KR) ..... 10-2018-0075765

(51) Int. Cl.
*H01R 13/627* (2006.01)
*H01R 13/514* (2006.01)
*H01R 12/72* (2011.01)

(52) U.S. Cl.
CPC ..... *H01R 13/514* (2013.01); *H01R 13/6273* (2013.01); *H01R 12/722* (2013.01)

(58) Field of Classification Search
CPC .. H01R 13/514; H01R 13/516; H01R 13/518; H01R 13/6273; H01R 12/722
USPC ..... 439/353
See application file for complete search history.

(56) References Cited

U.S. PATENT DOCUMENTS

| | | | |
|---|---|---|---|
| 4,230,387 | A | 10/1980 | Zahn |
| 5,011,425 | A | 4/1991 | Van Zanten et al. |
| 6,123,554 | A | 9/2000 | Ortega et al. |
| 6,619,995 | B1 | 9/2003 | Hayashi et al. |
| 6,769,922 | B1 | 8/2004 | Lee et al. |
| 2014/0087572 | A1 | 3/2014 | Saur et al. |
| 2018/0175571 | A1 | 6/2018 | Choo et al. |
| 2019/0267748 | A1 | 8/2019 | Kawahara |

FOREIGN PATENT DOCUMENTS

| | | | |
|---|---|---|---|
| CN | 1048125 | A | 12/1990 |
| CN | 2882016 | Y | 3/2007 |
| CN | 201188477 | Y | 1/2009 |
| CN | 102117988 | A | 7/2011 |

(Continued)

OTHER PUBLICATIONS

Extended European Search Report for Application No. 19826291.7 dated Nov. 25, 2020, 10 pages.

(Continued)

*Primary Examiner* — Khiem M Nguyen
(74) *Attorney, Agent, or Firm* — Lerner, David, Littenberg, Krumholz & Mentlik, LLP

(57) ABSTRACT

A connector assembly including a plurality of female connectors respectively having a predetermined number of pins, and at least one male connector having a plug terminal contacting the pin and coupled with the plurality of female connectors. The plurality of female connectors are provided to be assembled with each other along one direction.

10 Claims, 8 Drawing Sheets

(56) References Cited

FOREIGN PATENT DOCUMENTS

| | | | |
|---|---|---|---|
| CN | 205543471 | U | 8/2016 |
| CN | 108206364 | A | 6/2018 |
| FR | 2776844 | A3 | 10/1999 |
| JP | H8321348 | A | 12/1996 |
| JP | H09063724 | A | 3/1997 |
| JP | H9213406 | A | 8/1997 |
| JP | 2001148267 | A | 5/2001 |
| JP | 2004111318 | A | 4/2004 |
| JP | 2007115448 | A | 5/2007 |
| JP | 2008140731 | A | 6/2008 |
| JP | 200943661 | A | 2/2009 |
| JP | 2009259599 | A | 11/2009 |
| JP | 2010262854 | A | 11/2010 |
| JP | 2014078370 | A | 5/2014 |
| JP | 2015026511 | A | 2/2015 |
| KR | 20000015116 | U | 7/2000 |
| KR | 20010028221 | A | 4/2001 |
| KR | 200425697 | Y1 | 9/2006 |
| KR | 20080079362 | A | 9/2008 |
| KR | 20090013484 | A | 2/2009 |
| KR | 20130135308 | A | 12/2013 |
| KR | 101801706 | B1 | 12/2017 |
| WO | 2013018386 | A1 | 2/2013 |
| WO | 2017204021 | A1 | 11/2017 |

OTHER PUBLICATIONS

International Search Report for Application No. PCT/KR2019/003264 dated Jun. 28, 2019, 2 pages.
Chinese Search Report for Application No. 201980007315.X dated Jan. 12, 2021, 3 pages.

EXPANDABLE CONNECTOR ASSEMBLY

CROSS-REFERENCE TO RELATED APPLICATIONS

The present application is a national phase entry under 35 U.S.C. § 371 of International Application No. PCT/KR2019/003264 filed Mar. 20, 2019, published in Korean, which claims priority from Korean Patent Application 10-2018-0075765 filed Jun. 29, 2018, all of which are incorporated herein by reference.

TECHNICAL FIELD

The present disclosure relates to a connector, and more particularly, to an expandable connector assembly capable of increasing the number of pins of the connector by assembling unit male and female connectors, when it is needed to increase the number of pins of the connector.

BACKGROUND ART

As shown in FIG. 1, a conventional connector generally includes a female connector 2 and a male connector 3 in a pair. The female connector 1 has a plurality of pins corresponding to a contact, and the male connector 3 has a plurality of plug terminals that come into contact with the plurality of pins. The female connector 2 is mounted to the circuit board 1 by means of Surface Mounter Technology (SMT), and the male connector 3 is connected and fixed in the female connector 2.

However, if both the female connector 2 and the male connector 3 are used, different bodies and contacts of the female connector 2 and the male connector 3 should be prepared using different molds, and any one connector must be surface-mounted to a circuit board, which makes the manufacturing process complicated and increases the manufacturing cost.

In addition, in the conventional male and female connectors, the number of pins is predetermined, and the number of pins determines compatibility with a usable device or circuit board. In other words, if the number of pins is not identical between any connector and a circuit board, the connector is not useable. In this case, it is required to use male and female connectors with exactly the same number of pins or newly fabricate male and female connectors with the required number of pins.

In particular, in order to transmit one more signal to an existing device or circuit board, the number of pins must be increased by one to the male and female connectors. In this case, due to the structure of the existing connectors the male and female connectors must be replaced entirely.

Thus, there is a demand for a new type connector, which allows a connector pin to be easily added without replacing the existing male and female connectors.

SUMMARY

Technical Problem

The present disclosure is directed to improving compatibility and economic efficiency of male and female connectors by implementing the male and female connectors in an expandable manner, where several unit connectors may be consecutively assembled when it is required to increase the number of pins of the connector.

In addition, the present disclosure is directed to providing a connector assembly which may be prevented from being detached or disconnected due to external shocks or vibrations and also allow male and female connectors to be conveniently assembled and disassembled.

Technical Solution

In one aspect of the present disclosure, there is provided a connector assembly, comprising: a plurality of female connectors, each female connector having a predetermined number of pins; and at least one male connector having a plug terminal configured to be coupled with the pins of the plurality of female connectors, wherein the plurality of female connectors are configured to be assembled with each other along a first direction.

Each of the plurality of female connectors may include one pin, and the at least one male connector may include a plurality of male connectors that are respectively connected to the plurality of female connectors in one-to-one relationship.

The at least one male connector may be a single male connector integrally having plug terminals corresponding to a total number of pins of the plurality of female connectors and be connected to the plurality of female connectors in multi-to-one relationship.

Each of the plurality of female connectors may include a hooking protrusion on at least one of an upper end or a lower end of a front surface thereof to which the at least one male connector is connected, wherein the hooking protrusion is bent in a second direction perpendicular to the first direction, and the at least one male connector may include a hooking groove configured to be hooked with the hooking protrusion.

When the plurality of female connectors are assembled in one direction, the hooking protrusions of adjacent female connectors may be connected along a common direction.

Each of the plurality of female connectors may include a locking groove formed by depressing an inner surface on at least one of an upper end and a lower end of a front surface of the female connector to which the at least one male connector is connected, and the at least one male connector may include a locking pin positioned at either an upper end or a lower end of the at least one male connector, wherein the locking pin is configured to be locked to or unlocked from the locking groove by means of a structure performing a seesawing motion.

Each of the plurality of female connectors may include a convex block formed at a first side surface thereof to protrude in the first direction and a concave groove formed at an opposing second side surface thereof to depress corresponding to the convex block, and adjacent first and second female connectors may be configured to be connected to each other by sliding the convex block of the first female connector into the concave groove of the second female connector.

The convex block may have a "T" shape, and the concave groove may be shaped to engage with the convex block.

Each of the plurality of female connectors may include a first uneven portion formed at a first side surface thereof and including alternating ridges and valleys; and a second uneven portion formed at an opposing second side surface thereof and shaped to engage with the first uneven portion, wherein adjacent first and second female connectors are connected to each other by fitting the first uneven portion into the second uneven portion by a sliding motion in a second direction perpendicular to the first direction.

The first uneven portion may be shaped in a saw-tooth pattern inclined in one direction.

Advantageous Effects

According to an embodiment of the present disclosure, when it is necessary to increase the number of pins of a connector, it is possible to expand the male and female connectors by successively assembling several unit connectors, thereby improving compatibility and economic efficiency of the male and female connectors, compared to the conventional technique.

Also, by assembling unit male and female connectors, it is possible to easily construct a connector assembly with the required number of pins.

In addition, it is possible to provide a connector assembly, which may be prevented from being detached or disconnected due to external shocks or vibrations and also allow the male and female connectors to be conveniently assembled and disassembled.

DETAILED DESCRIPTION

Hereinafter, preferred embodiments of the present disclosure will be described in detail with reference to the accompanying drawings. Prior to the description, it should be understood that the terms used in the specification and the appended claims should not be construed as limited to general and dictionary meanings, but interpreted based on the meanings and concepts corresponding to technical aspects of the present disclosure on the basis of the principle that the inventor is allowed to define terms appropriately for the best explanation.

Therefore, the description proposed herein is just a preferable example for the purpose of illustrations only, not intended to limit the scope of the disclosure, so it should be understood that other equivalents and modifications could be made thereto without departing from the scope of the disclosure.

In the following description, a circuit board may refer to a Battery Management System (BMS) circuit board applied to a battery pack for a vehicle. Here, the BMS circuit board is a component of the battery pack for controlling charge/discharge and cell balancing of battery cells. A connector assembly according to the present disclosure may be connected to the BMS circuit board to transmit voltage information or the like of the battery cells to the BMS.

Here, the connector assembly of the present disclosure may be connected to a printed circuit board of an electronic device such as a laptop, a tablet PC, a smart phone, or the like, in addition to the BMS circuit board, to transmit a signal necessary for the electronic device.

Figure 1:
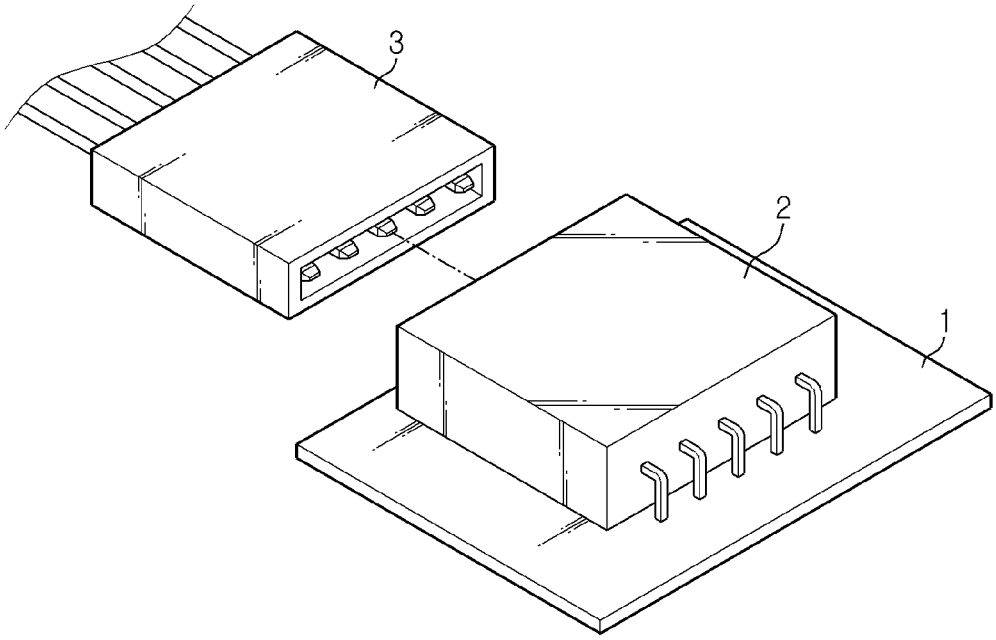
PRIOR ART FIG. 1
FIG. 1 is a diagram schematically showing conventional male and female connectors.
Figure 2:
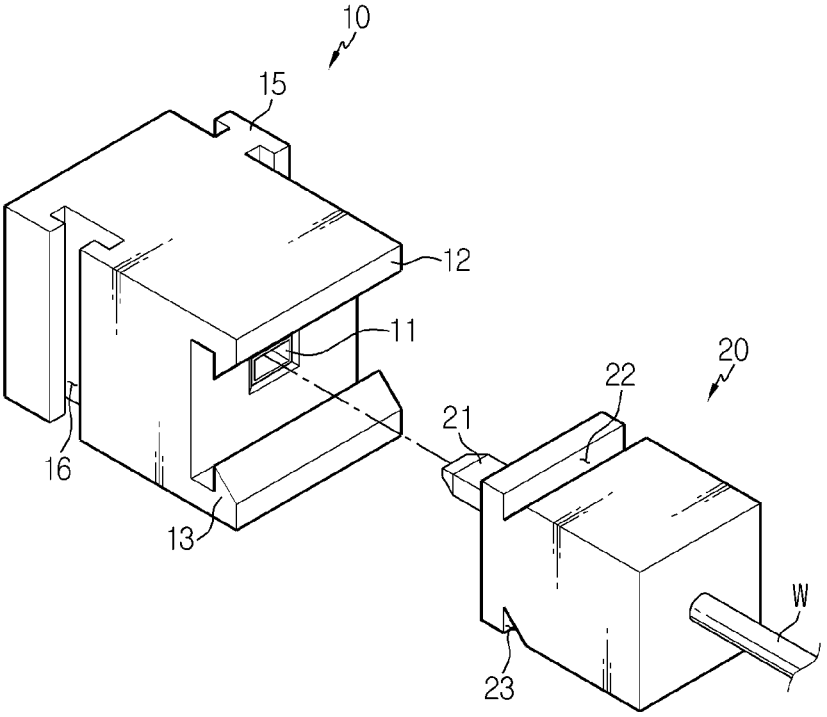
FIG. 2 is a schematic perspective view showing unit male and female connectors according to an embodiment of the present disclosure.
Figure 3:
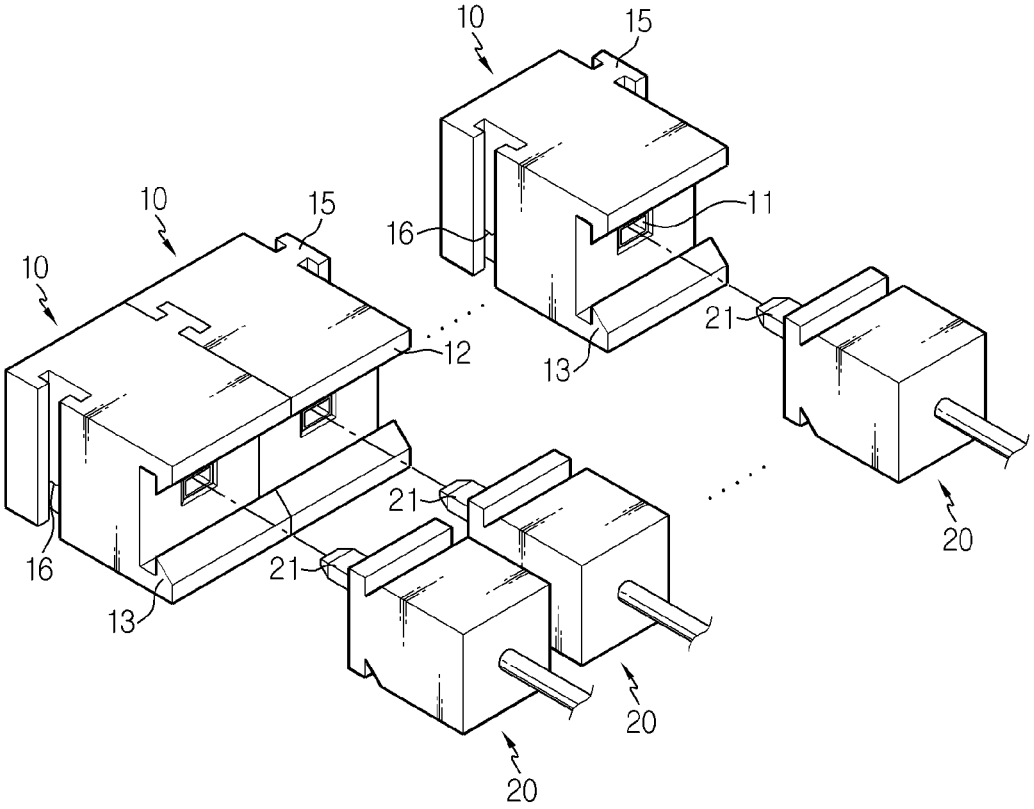
FIG. 3 is a schematic perspective view showing male and female connectors, which are configured by assembling the unit male and female connectors of FIG. 2.
Figure 4:
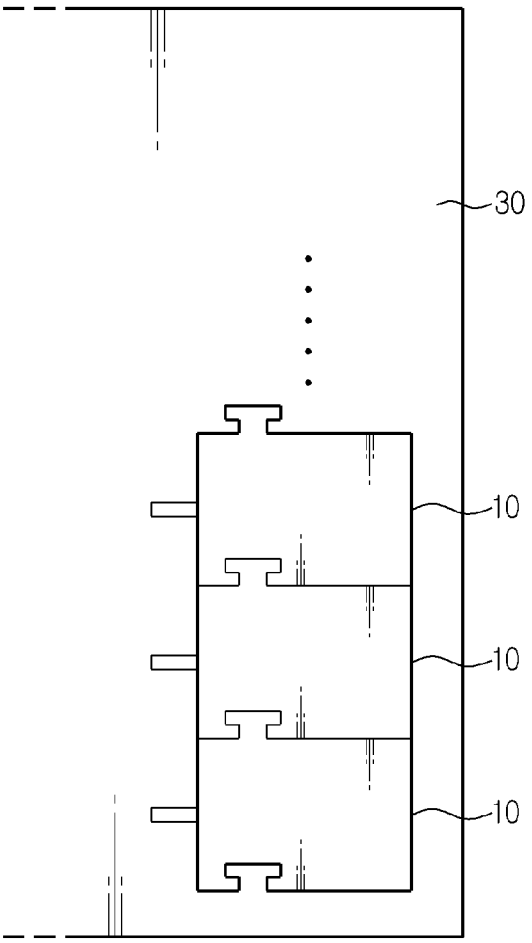
FIG. 4 is a schematic top view showing the female connectors of this embodiment, which are installed to a circuit board.

FIG. 2 is a schematic perspective view showing unit male and female connectors according to an embodiment of the present disclosure, FIG. 3 is a schematic perspective view showing male and female connectors, which are configured by assembling the unit male and female connectors of FIG. 2, and FIG. 4 is a schematic top view showing the female connectors of this embodiment, which are installed to a circuit board.

The connector assembly according to an embodiment of the present disclosure includes a plurality of female connectors 10 provided to be assembled with each other along one direction, and an at least one male connector 20 coupled to the female connectors 10.

Each of the female connectors 10 accommodates a predetermined number of pins 11 therein. Although the female connector 10 according to this embodiment is illustrated as accommodating one pin 11, the female connector 10 may accommodate two or more pins 11. However, as will be explained later, in order to vary the overall number of pins 11 of the connector assembly, it may be advantageous to use the female connectors 10 respectively having one or two pins 11, or to use the female connectors 10 respectively having one pin 11 and the female connectors 10 respectively having two pins in combination.

The plurality of female connectors 10 respectively having one pin 11 may be connected successively in one direction as shown in FIGS. 3 and 4. If the unit female connectors 10 are successively assembled as above, it is possible to configure a female connector 10 having various numbers of pins 11. In other words, if it is necessary to decrease or increase the number of pins 11 of the female connector 10 to be connected to a circuit board 30, in the conventional art, the female connector itself must be replaced. However, according to the present disclosure, the number of pins 11 of the female connector 10 can be increased or decreased just by separating or adding one unit female connector 10. Thus, the cost of replacing the female connector may be reduced and the labor required for mounting the female connector to the circuit board may be reduced.

The assembling structure and method of the plurality of female connectors 10 according to an embodiment of the present disclosure may be implemented as follows.

The unit female connector 10 includes a convex block 15 formed at one side thereof to protrude therefrom and a concave groove 16 formed at the other side thereof to be depressed in a shape corresponding to the convex block 15.

For example, the convex block 15 has a cross-section of an approximately alphabetical "T" shape and extends along the height direction. Also, the concave groove 16 forms an empty space that engages with the convex block.

Any one unit female connector 10 and another female connector 10 may be connected to each other by fitting the convex block 15 and the concave groove 16 vertically.

In other words, two unit female connectors 10 may be connected into one body by fitting the convex block 15 of any one unit female connector 10 into the concave grooves 16 of another female connector 10 the from top to bottom.

Since the two unit female connectors 10 engage with each other by means of the convex block 15 and the concave groove 16 having a "T" shape, the two unit female connectors 10 may be tightly fastened with each other without relatively moving in the forward, backward, left and right directions.

Though the convex block 15 and the concave groove 16 are formed in the "T" shape in this embodiment, the convex block 15 and the concave groove 16 may have any shape such as an "L" shape as long as the convex block 15 convexly formed at one side surface of the unit female connector 10 and the concave groove 16 concavely formed at the other side surface of the unit female connector 10 are capable of engaging with each other.

In such a pattern, other unit female connectors 10 may be assembled and connected to the two unit female connectors 10 such that a plurality of female connectors 10 having a required number of pins 11 are connected.

Meanwhile, the male connector 20 may include a plurality of unit male connectors 20 that are connected to the unit female connectors 10 in one-to-one relationship. In this case, the unit male connector 20 is implemented to have only one plug terminal 21 that contacts one pin 11 of the female connector 10.

Figure 5:
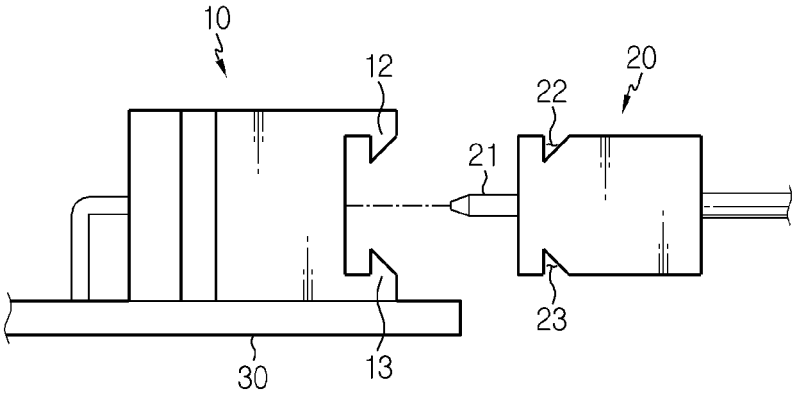
FIGS. 5 and 6 are diagrams for illustrating a fastening structure between the male and female connectors of this embodiment.
Figure 6:
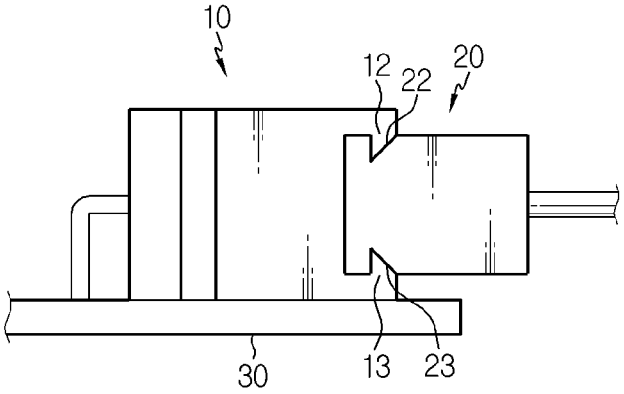

FIGS. 5 and 6 are diagrams for illustrating a fastening structure between the male and female connectors 10, 20 of this embodiment.

Next, a fastening structure of the female connector 10 and the male connector 20 according to this embodiment will be described with reference to FIGS. 5 and 6 along with FIG. 2.

The female connector 10 has hooking protrusions 12, 13 bent in a vertical direction on at least one of an upper end and a lower end of a front surface thereof to which the male connector 20 is connected. Also, the male connector 20 has hooking grooves 22, 23 provided to be hooked to the hooking protrusions 12, 13.

In this embodiment, the hooking protrusions 12, 13 are provided to both the upper end and the lower end of the front surface of the female connector 10 for enhanced coupling, and the hooking grooves 22, 23 corresponding thereto are provided to the upper end and the lower end of the front surface of the male connector 20.

As shown in FIGS. 5 and 6, if the front end of the male connector 20 is inserted into the front end of the female connector 10, the hooking grooves 22, 23 of the male connector 20 are hooked by the hooking protrusions 12, 13 of the female connector 10, and thus the male connector 20 is not easily taken out of the female connector 10 in a reverse direction.

In order to separate the male connector 20 from the female connector 10, in a state where the hooking protrusions 12, 13 of the female connector 10 are slightly widened, the male connector 20 should be pulled in the reverse direction. Although not shown in detail, the plug terminal 21 of the male connector 20 may be inserted in a receptacle manner to contact the pin 11 of the female connector 10, which is located inside the female connector 10.

Figure 7:
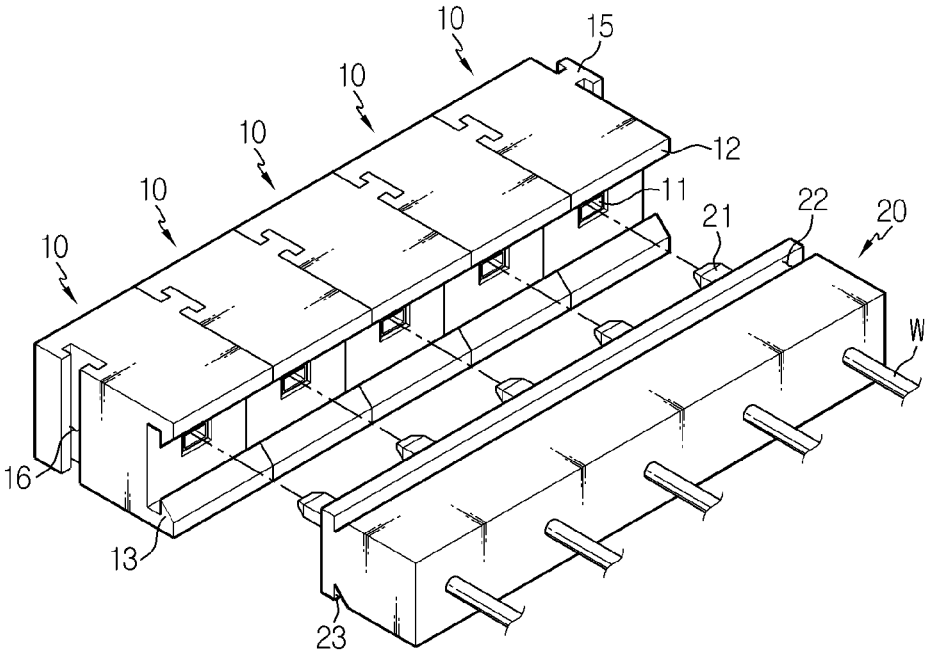
FIG. 7 is a diagram corresponding to FIG. 2 and showing a modified example of the male connector.

FIG. 7 is a diagram corresponding to FIG. 2 and showing a modified example of the male connector 20.

Meanwhile, in a modified example, the male connector 20 according to this embodiment is provided in a single number. In other words, the male connector 20 according to the modified example integrally includes plug terminals 21 corresponding to the total number of pins 11 of the plurality of unit female connectors 10 and is connected to the female connectors 10, which are assembled with each other on the circuit board 30, in a multi-to-one structure.

As shown in FIG. 7, the female connectors 10 assembled with each other have a front end opened in the lateral direction, and the hooking protrusions 12, 13 of any one female connector 10 and the hooking protrusions 12, 13 of another neighboring female connector 10 are connected along the assembling direction.

In addition, the hooking grooves 22, 23 of the male connector 20 may be formed in a size corresponding to the connected hooking protrusions 12, 13. Thus, even if the front end of any one male connector 20 is inserted into the front end of the plurality of female connectors 10, the hooking grooves 22, 23 of the male connector 20 may be hooked to all of the hooking protrusions 12, 13 of the female connectors 10.

Since the male connector 20 also serves to bind a plurality of wires W into a bundle, it is advantageous to integrate the male connector 20 into one connector rather than dividing into several connectors. Also, since the male connector 20 is not mounted to the circuit board 30, the male connector 20 may be exchanged more easily than the female connector 10. For this reason, the connector assembly according to the modified example may be more effective than the connector assembly having the one-to-one connection structure of the male and female connectors 10, 20 described above.

Next, a connector assembly according to another embodiment of the present disclosure will be described with reference to FIGS. 8 to 10.

When explaining the connector assembly according to another embodiment of the present disclosure, features different from the former embodiment will be described in detail, and features identical to the former embodiment will not be described in detail.

Figure 8:
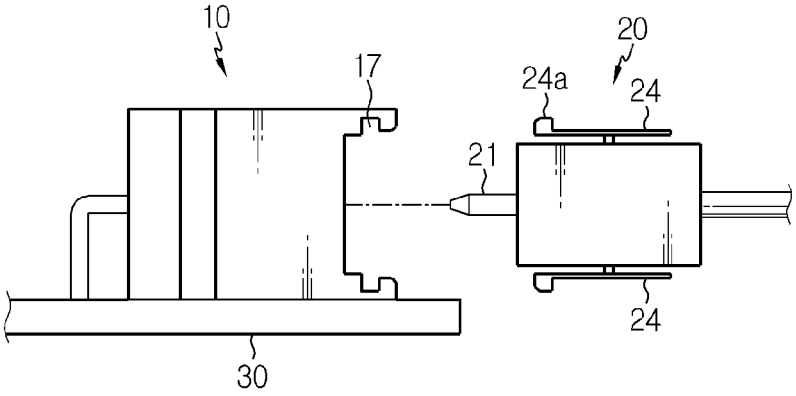
FIGS. 8 and 9 are diagrams for illustrating a fastening structure between male and female connectors according to another embodiment of the present disclosure.
Figure 9:
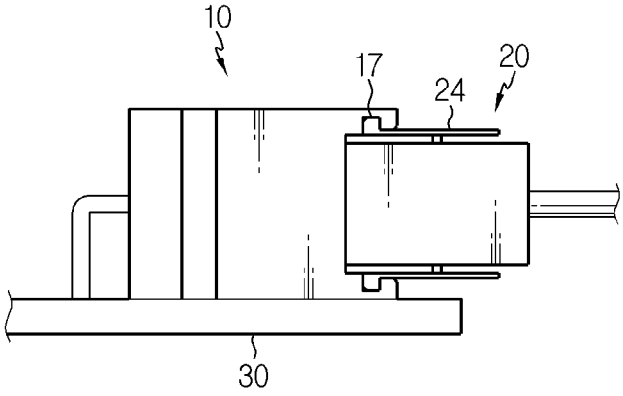

FIGS. 8 and 9 are diagrams for illustrating a fastening structure between male and female connectors 10, 20 according to another embodiment of the present disclosure.

Referring to FIGS. 8 and 9, the female connector 10 according to another embodiment of the present disclosure has a locking groove 17 formed by depressing an inner surface of at least one of an upper end and a lower end of a front surface thereof to which the male connector 20 is connected.

In addition, the male connector 20 has a locking pin 24 provided at an upper end or a lower end thereof to be locked to or unlocked from the locking groove 17 by means of a seesawing structure.

Referring to FIGS. 8 and 9, the locking pin 24 may be integrally formed at an outer side of a housing of the male connector 20 such that, if one end thereof based on a support point located at one site is pressed, the other end is lifted. The other end of the locking pin 24 may be provided with a projection **24*a* that at least partially engages with the locking groove 17 of the female connector 10**.

The fastening structure between the male and female connectors 10, 20 according to this embodiment may the male and female connectors 10, 20 from being broken or deformed when the male connector 20 is inserted into or separated from the female connector 10.

In the above embodiment, when the male connector 20 is inserted into or separated from the female connector 10, the hooking protrusions 12, 13 of the female connector 10 should be widened so that the male connector 20 may pass into and out of the front end of the female connector 10. However, even if the female connector 10 is made of a material elastically deformable within a certain range, when the female and female connectors 10, 20 are repeatedly fastened, the coupling force of the female connector 10 is weakened due to deformation or breakage thereof.

Meanwhile, according to this embodiment, when the male connector 20 is inserted into or separated from the female connector 10, the male connector 20 may be inserted or separated by appropriately using the locking pin 24 without widening the front end of the female connector 10. In other words, the male connector 20 may be inserted into or separated from the female connector 10 in a state of pressing a front portion of the locking pin 24. Alternatively, the male connector 20 may also be inserted into or separated from the female connector 10 in a state of slightly lifting up a rear portion of the locking pin 24 with a predetermined tool.

If the locking pin 24 according to this embodiment is used, there is no need to widen the front end of the female connector 10 or forcibly press the front end of the male connector 20 into the front end of the female connector 10. Thus, while the male and female connectors 10, 20 are fastened or released, it is possible to minimize the damage of the male and female connectors 10, 20, thereby improving the coupling force and durability of the male and female connectors 10, 20.

Figure 10:
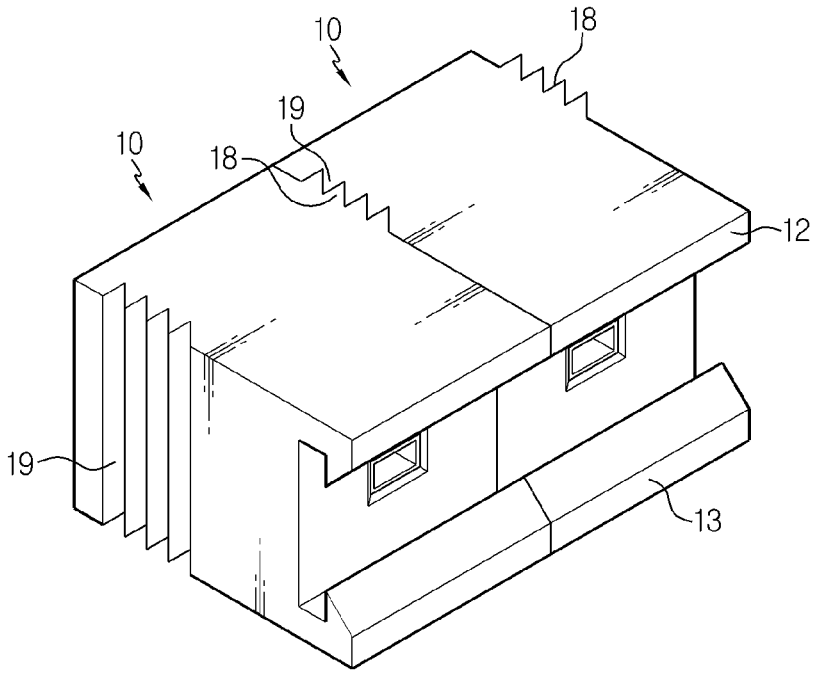
FIGS. 10 and 11 are diagrams for illustrating an assembling structure of a plurality of female connectors according to still another embodiment of the present disclosure.
Figure 11:
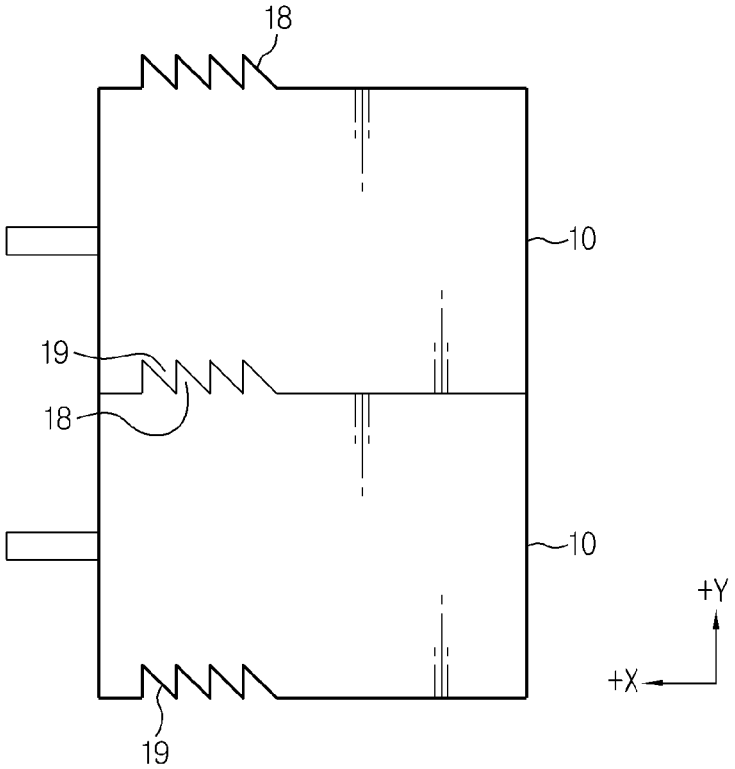

FIGS. 10 and 11 are diagrams for illustrating an assembling structure of a plurality of female connectors 10 according to still another embodiment of the present disclosure.

Referring to FIGS. 10 and 11, the female connector 10 according to still another embodiment of the present disclosure includes a first uneven portion 18 formed at one side surface thereof and having ridges and valleys repeatedly and a second uneven portion 19 formed at the other side surface thereof to engage with the first uneven portion 18.

Any one female connector 10 and another female connector 10 may be connected to each other by fitting the first uneven portion 18 vertically into the second uneven portion 19. The first uneven portion 18 and the second uneven portion 19 according to this embodiment may correspond to the convex block 15 and the concave groove 16 of the former embodiment.

However, the first uneven portion 18 and the second uneven portion 19 according to this embodiment may easily adjust the number and depth of ridges and valleys at both side surfaces of the female connector 10, compared to the convex block 15 and the concave groove 16 of the former embodiment having a "T" shape. Thus, the unit female connector 10 of this embodiment may be manufactured into a slim design more easily than the female connector 10 of the former embodiment.

The unit female connector 10 having one pin 11 should be made as slim as possible so that the entire female connector 10 formed by connecting unit female connectors may have a compact design. In this regard, the assembling structure of the female connectors 10 according to this embodiment may be more advantageous in slimming the unit female connector 10 and the entire female connector 10 formed by connecting unit female connectors, compared to the former embodiment.

The +X-axis direction of FIG. 11 is a direction in which the pin 11 of the female connector 10 is electrically connected to a conductive pattern of the circuit board 30 when the female connector 10 is mounted to the circuit board 30. If vibration or an external force is applied, the female connectors 10 may be pushed in the +X-axis direction, which may cut the electrical connection between the pin 11 of the female connector 10 and the conductive pattern of the circuit board 30. Thus, it is particularly needed to fix the female connector 10 to the circuit board 30 such that the female connector 10 is not pushed in the +X axis direction.

To this end, the first uneven portion 18 and the second uneven portion 19 according to this embodiment may be provided to have a saw-tooth form inclined in one direction as shown in FIG. 11.

In a state where the first uneven portion 18 and the second uneven portion 19 formed as above engage with each other, even if an external force is applied, the possibility that any one unit female connector 10 is separated from another unit female connector 10 and moves in the +X axis direction of in FIG. 11 is very low. That is, if the unit female connectors 10 are connected as in this embodiment, even if there is external vibration, the possibility that the unit female connectors 10 are individually separated and move in the +X axis direction to cut the electric connection with the conductive pattern of the circuit board 30 may be greatly lowered.

The present disclosure has been described in detail. However, it should be understood that the detailed description and specific examples, while indicating preferred embodiments of the disclosure, are given by way of illustration only, since various changes and modifications within the scope of the disclosure will become apparent to those skilled in the art from this detailed description.

Meanwhile, when the terms indicating up, down, left and right directions are used in the specification, it is obvious to those skilled in the art that these merely represent relative locations for convenience in explanation and may vary based on a location of an observer or an object to be observed.

What is claimed is:

1. A connector assembly, comprising:

a plurality of female connectors configured to be mounted to a surface of a printed circuit board by surface-mount technology, each female connector having a predetermined number of pins; and at least one male connector having a plug terminal configured to be coupled with the pins of the plurality of female connectors by inserting the plug terminal along a first axis, wherein the plurality of female connectors are configured to be assembled with each other along a first direction, wherein each of the plurality of female connectors includes a convex block formed at a first side surface thereof to protrude in the first direction and a concave groove formed at an opposing second side surface thereof to depress corresponding to the convex block, and wherein adjacent first and second female connectors are configured to be connected to each other by sliding the convex block of the first female connector into the concave groove of the second female connector along a second axis different from the first axis wherein the convex block has a "T" shape, and wherein the concave groove is shaped to engage with the convex block.

2. The connector assembly according to claim 1, wherein each of the plurality of female connectors includes one pin, and wherein the at least one male connector includes a plurality of male connectors that are respectively connected to the plurality of female connectors in a one-to-one relationship.

3. The connector assembly according to claim 1, wherein the at least one male connector is a single male connector integrally having plug terminals corresponding to a total number of pins of the plurality of female connectors and is connected to the plurality of female connectors in a multi-to-one relationship.

4. The connector assembly according to claim 1, wherein each of the plurality of female connectors includes a hooking protrusion on at least one of an upper end or a lower end of a front surface thereof to which the at least one male connector is connected, wherein the hooking protrusion is bent in a second direction perpendicular to the first direction, and wherein the at least one male connector includes a hooking groove configured to be hooked with the hooking protrusion.

5. The connector assembly according to claim 4, wherein when the plurality of female connectors are assembled in one direction, the hooking protrusions of adjacent female connectors are connected along a common direction.

6. The connector assembly according to claim 1, wherein the each of the plurality of female connectors has a locking groove formed by depressing an inner surface on at least one of an upper end or a lower end of a front surface of the female connector to which the at least one male connector is connected, and wherein the at least one male connector includes a locking pin positioned at either an upper end or a lower end of the at least one male connector, wherein the locking pin is configured to be locked to or unlocked from the locking groove by means of a structure performing a seesawing motion.

7. A connector assembly comprising:

a plurality of female connectors configured to be mounted to a surface of a printed circuit board by surface-mount technology, each female connector having a predetermined number of pins; and at least one male connector having a plug terminal configured to be coupled with the pins of the plurality of female connectors by inserting the plug terminal along a first axis, wherein the plurality of female connectors are configured to be assembled with each other along a first direction, wherein each of the plurality of female connectors includes:

a first uneven portion formed at a first side surface thereof and including alternating ridges and valleys; and a second uneven portion formed at an opposing second side surface thereof and shaped to engage with the first uneven portion, wherein adjacent first and second female connectors are connected to each other by fitting the first uneven portion into the second uneven portion by a sliding motion along a second axis different from the first axis and perpendicular to the first direction.

8. The connector assembly according to claim 7, wherein the first uneven portion is shaped in a saw-tooth pattern inclined in one direction.

9. The connector assembly according to claim 1, wherein each of the plurality of female connectors is configured to be mounted to a surface of a printed circuit board by surface-mount technology, and wherein the first female connector is configured to be connected to the second female connector while the second female connector is surface-mounted by sliding the convex block of the first female connector into the concave groove of the surface-mounted second female connector along the second axis.

10. The connector assembly according to claim 7, wherein each of the plurality of female connectors is configured to be mounted to a surface of a printed circuit board by surface-mount technology, and wherein the first female connector is configured to be connected to the second female connector while the second female connector is surface-mounted by fitting the first uneven portion into the second uneven portion by the sliding motion along the second axis.

* * * * *